US005465759A

United States Patent [19]

Carlson et al.

[11] Patent Number: 5,465,759

[45] Date of Patent: Nov. 14, 1995

[54] VARIABLE DIAMETER PIPE PROTECTOR

[75] Inventors: Douglas W. Carlson; Stephen P. Simmons, both of Kingwood, Tex.

[73] Assignee: Hydril Company, Houston, Tex.

[21] Appl. No.: 215,903

[22] Filed: Mar. 22, 1994

[51] Int. Cl.[6] ..... F16L 57/00

[52] U.S. Cl. ..... 138/110; 138/96 R; 138/108; 175/325.5; 175/325.7

[58] Field of Search ..... 138/110, 96 R, 138/96 T, 108; 175/325.1, 325.4–325.7; 403/344

[56] References Cited

U.S. PATENT DOCUMENTS

| | | | |
|---|---|---|---|
| 2,877,062 | 3/1959 | Hall et al. | 175/325.5 |
| 3,094,018 | 6/1963 | Collett . | |
| 3,148,004 | 9/1964 | Hall et al. . | |
| 3,164,216 | 1/1965 | Hall, Sr. et al. . | |
| 3,197,262 | 7/1965 | Fairchild . | |
| 3,227,498 | 1/1966 | Leathers . | |
| 3,397,017 | 8/1968 | Grant et al. . | |
| 3,410,613 | 11/1968 | Kuus . | |
| 3,411,837 | 11/1968 | Schellstede . | |
| 3,425,757 | 2/1969 | Minor . | |
| 3,449,022 | 6/1969 | Minor . | |
| 3,458,922 | 8/1969 | Schellstede et al. . | |
| 3,484,122 | 12/1969 | Schellstede et al. . | |
| 3,588,199 | 6/1971 | Hopmans | 175/325 X |
| 3,612,627 | 10/1971 | Fuller | 175/325.6 |
| 3,652,138 | 3/1972 | Collett | 175/325.7 |
| 3,709,569 | 1/1973 | Napper | 175/325.7 |
| 3,804,168 | 4/1974 | Marshall et al. | 175/45 X |
| 3,893,778 | 7/1975 | Williams | 304/344 |
| 3,894,780 | 7/1975 | Broussard | 175/325.6 |
| 3,948,575 | 4/1976 | Rosser | 175/325 |
| 3,999,811 | 12/1976 | Gray | 175/325.5 |
| 4,072,369 | 2/1978 | Segreto | 175/325.7 |
| 4,199,011 | 3/1980 | Kreft et al. | 138/110 |
| 4,205,707 | 6/1980 | Lundgren | 138/96 R |
| 4,266,578 | 5/1981 | Swain et al. | 138/110 |
| 4,279,850 | 7/1981 | Lynch | 264/135 |
| 4,281,722 | 8/1981 | Tucker et al. | 175/57 |
| 4,318,426 | 3/1982 | Callanan et al. | 138/96 T |
| 4,354,529 | 10/1982 | Soutos et al. | 138/96 T |
| 4,398,772 | 8/1983 | Odell | 175/325.6 |
| 4,796,670 | 1/1989 | Russell et al. | 138/110 |
| 4,907,661 | 3/1990 | Lloyd | 175/325 |
| 5,069,297 | 12/1991 | Krueger et al. | 175/325.9 |

FOREIGN PATENT DOCUMENTS

| | | | |
|---|---|---|---|
| 1314130 | 4/1973 | United Kingdom | 138/96 R |

OTHER PUBLICATIONS

Garkasi, Ali, Russell W. Hall, Jr., and W. Gregory Deskins, "Laboratory Drill Pipe Protector Tests", Drilling Technology, PD–vol. 56, 1994, pp. 63–68.

*Primary Examiner*—David Scherbel
*Assistant Examiner*—Patrick F. Brinson
*Attorney, Agent, or Firm*—Vaden, Eickenroht, Thompson & Feather

[57] ABSTRACT

A pipe protector is disclosed comprising a tubular rubber member with an inner diameter sized to the approximate outer diameter of a pipe. The protector is a variable diameter pipe protector that prevents slipping on undersized pipes, but can also be used on full sized pipes. The pipe protector is capable of surrounding a full size outer diameter pipe and is provided with at least one rubber flap attached to the inside surface to compensate for undersize pipe diameters.

9 Claims, 3 Drawing Sheets

VARIABLE DIAMETER PIPE PROTECTOR

BACKGROUND AND SUMMARY OF THE INVENTION

Pipe protectors are tubular rubber members that surround pipe used in downhole drilling operations. The rubber pipe protector serves as a bumper for the pipe which is generally introduced into metal casing in the well hole. The pipe protector should fit snugly around the outside diameter of the pipe. During the drilling operation the pipe is rotated rapidly. If the pipe protector is not secure, slippage can occur and the pipe protector will slide off of the desired location on the pipe.

Reliable pipe protectors are necessary during directional drilling operations during which process the well is drilled at an angle in a non-vertical direction. The pipe will contact the casing wall with metal to metal contact that causes wear on the pipe. By spacing pipe protectors along the pipe string, the rubber pipe protectors rather than the pipe contact the well casing.

A typical pipe protector well known to those in the art is a split type pipe protector. The tubular rubber member is typically about 4 to 12 inches in length and has an opening the length of the member that can be further opened to facilitate installation onto the pipe. After the pipe is enclosed and encircled by the pipe protector, the rubber tubular member is secured or fastened. Many split type pipe protectors have interlocking metal teeth covered by rubber and close with a key fastener inserted lengthwise through the teeth. The metal teeth are connected to a cylindrical metal insert inside the tubular rubber member. The metal insert may be smooth or corrugated metal.

The inner diameter of the pipe protector is sized to match the outer diameter of the drill pipe. The conventional pipe protectors are sensitive to the outer diameter dimension of the pipe on which they are installed. Changes in the outer diameter of the pipe of about (–)0.010 inch reduce the gripping forces of the pipe protector and allow the protector to slip or rotate on the pipe at relatively low side forces. Drill pipe commonly can vary in outer diameter by –0.05% depending on pipe size. Conventional pipe protectors slip on the undersized pipe and fail to provide the desired bumper effect and can be detrimental to the drilling operation. It is possible to lose the pipe protector downhole. The drilling operation must then be shut down to fish out the pipe protector. Slipping of undersized pipe protectors on drill pipe is a serious problem. Attempts to alleviate this problem have included wrapping strips of rubber around the pipe circumference before placing the pipe protector onto the pipe. Although this method was moderately successful in reducing slippage, it is tedious and impractical in field applications.

The present invention provides a variable diameter pipe protector that prevents slipping on undersized pipe, but can also be used on full sized pipe. A pipe protector capable of surrounding a full size outer diameter pipe is provided with at least one rubber flap attached to the inside surface. In one embodiment the rubber flap attached to the inside surface can be cut. The severed portion is removed leaving the remaining portion of the flap attached. The flap provides sufficient inner diameter thickness to compensate for the undersized pipe. The smaller the diameter of the pipe the more of the flap is left inside the pipe protector to serve as additional volume of rubber needed to give a tight grip on the pipe. In a preferred embodiment the flap extends substantially the length of the rubber tubular member. If the pipe is sized to the full diameter, the flap is completely detachable and can be removed. The pipe protector can be a split type design with an opening the length of the rubber tubular member. The opening the length of the tubular rubber member is capable of separation to facilitate the introduction of the pipe. A closing means is used to secure the pipe protector for installation after the flap material has been cut and detached. The cylindrical metal insert with interlocking metal teeth is typically included in this design.

In an alternative embodiment, multiple detachable rubber flaps are attached to the inside surface of the pipe protector. During installation of the pipe protector on the pipe, as many flaps as needed to provide a tight grip are left attached to the inside the pipe protector. The flap or flaps are preferably attached with an adhesive for relatively easy removal. The flaps are placed on the inside surface of the rubber tubular member so as not to overlap each other.

Conventional split type pipe protectors can be adapted with a detachable flap or flaps to accompany undersized pipe of various diameters.

DETAILED DESCRIPTION OF THE INVENTION

The pipe protectors of this invention can be made from polymers generally used for downhole drilling, and known to those skilled in the art. A preferred rubber is high acrylonitrile butadiene copolymer also known as nitrile base polymer. The range of durometer hardness for the tubular member is from about 50 Shore A to about 80 Shore A. The preferred range is from about 65–70 Shore A durometer hardness. The rubber flaps are made within the same range of durometer hardness, but do not have to be the same durometer hardness as the tubular member. In a preferred embodiment rubber characterized by high coefficients of friction can be used.

The acrylonitrile copolymer rubber has oil and fuel resistance, high tensile and tear strength, abrasion and gas impermeability resistance and heat resistance. The acrylonitrile copolymer rubber can be compounded with other additives known to those skilled in the art to improve and enhance certain characteristics. In the preferred embodiment the flaps are made of rubber with similar chemical and physical characteristics and chemical resistance.

A preferred polymer formula for a colored noncarbon reinforced rubber is shown in Table 1 below.

TABLE 1

| Colored Non Carbon Reinforced Polymer | |
|---|---|
| Component | Parts Per Hundred Polymer |
| NBR Polymer | 100 |
| Zinc Oxide | 4–9 |
| silica | 25–60 |
| Stearic Acid | 1.0–1.5 |
| Antioxidants and Antiozonants | 3.5–10.0 |
| Processing Oils | 25–50 |
| Reinforcing Resin and Resin Curative | 5–15 |
| Iron Oxide Colorant | 3–8 |
| Sulfenamide Curative | 2–5.5 |
| Thiuram Curative | 1.5–4.5 |

A preferred polymer formula for a carbon black reinforced polymer stock is shown in Table 2 below.

TABLE 2

| Black Carbon Reinforced Polymer | |
|---|---|
| Component | Parts Per Hundred Polymer |
| NBR Polymer | 100 |
| Zinc Oxide | 4–9 |
| Stearic Acid | 1.0–1.5 |
| Carbon Black (N774) | 30–70 |
| Antioxidant and Antiozonants | 3.5–10.0 |
| Processing Oils | 25–50 |
| Reinforcing Resin and Resin Curative | 5–15 |
| Sulfenamide Curative | 2–5.5 |
| Thiuram Curative | 1.5–4.5 |

Figure 1:
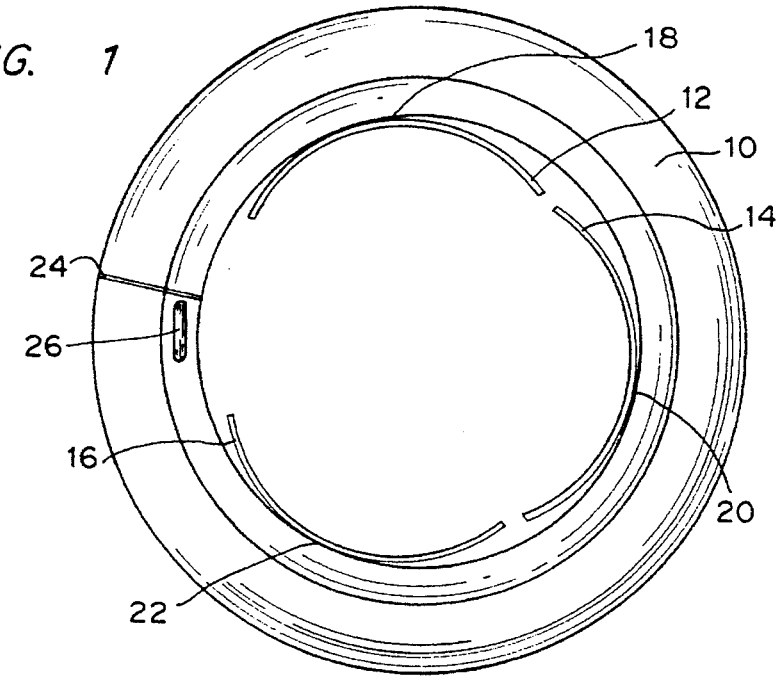
FIG. 1 is a top view of one of the preferred embodiments of the variable bore pipe protector showing three detachable flaps.

A preferred embodiment of the variable bore pipe protector is illustrated in the figures accompanying the application. FIG. 1 is a top view of one of the preferred embodiments with multiple flaps. The pipe protector in FIG. 1 has three rubber flaps to accommodate a relatively wide range of outer pipe diameters. Specifically, pipe protector body 10 is a generally tubular rubber member. Flaps 12, 14, and 16 are attached to the inside surface of the tubular member 10. The points of attachment 18, 20 and 22 to hold the rubber flaps in place are provided preferably by an adhesive suitable for two rubber parts. Also shown in the top view is the opening 24 typical in a split type pipe protector that is capable of separation to facilitate the installation of the pipe. The top of the latch key 26 is also shown.

Figure 2:
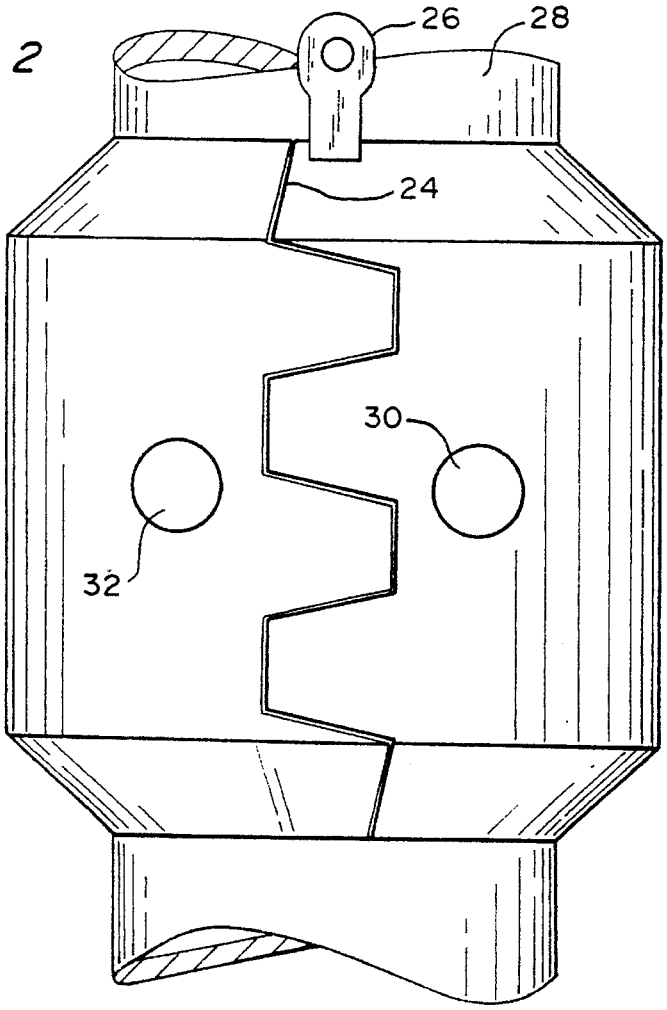
FIG. 2 is a side view of the variable bore pipe protector installed onto a length of pipe.

FIG. 2 is a side view of the split type pipe protector installed onto a pipe 28. The flaps 12, 14 and 16 are not visible in this view. The opening in the pipe protector consists of interlocking teeth formed by the cut of the opening 24. Key 26 is inserted through the teeth to close and secure the tubular member 10 around the pipe 28. The tubular member has installation holes 30 and 32 provided to facilitate closing the tubular member 10 around pipe 28.

Figure 3:
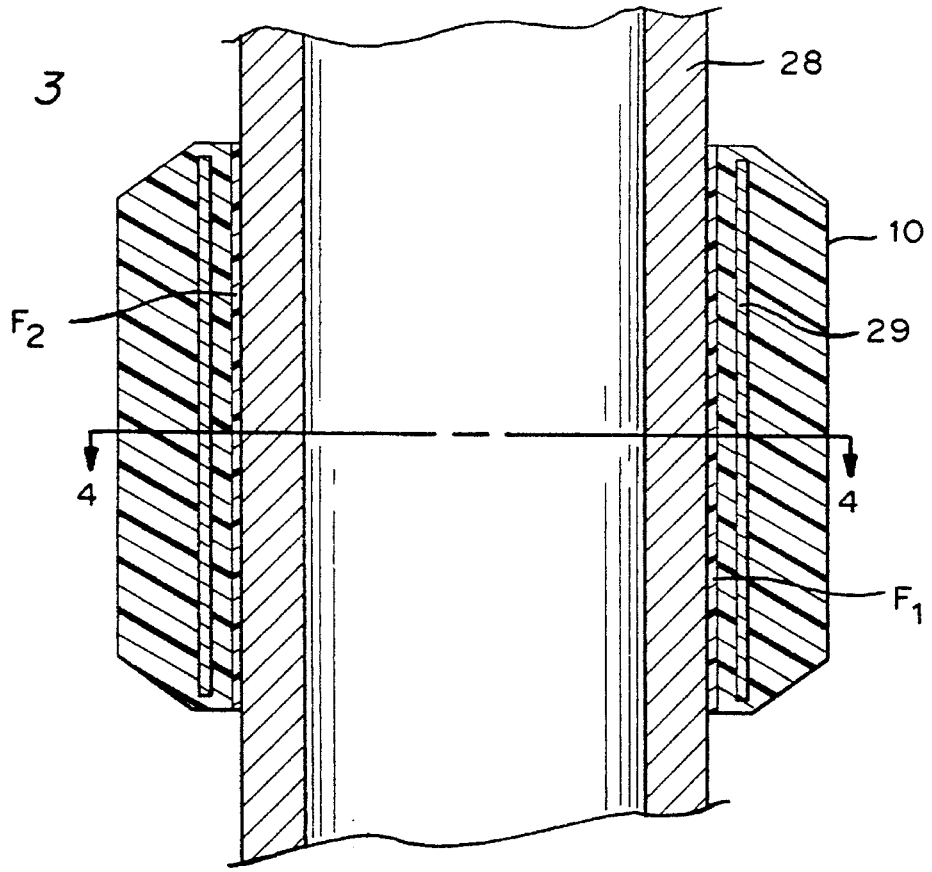
FIG. 3 is a lengthwise section through the installed pipe protector and pipe.

FIG. 3 is a lengthwise section through a portion of pipe 28 with at least two flaps shown between the pipe 28 and tubular member 10. In FIG. 3 the flaps are designated as $F_1$ and $F_2$ for reference. FIG. 1 shows a multiple flap embodiment, and the flaps shown in the section in FIG. 3 are two of the three flaps shown in FIG. 1. The reference numerals for the parts other than the flaps correspond to those used in the other figures for ease of comparison. The lengthwise section shows the cylindrical metal member 29 which is an insert in the rubber tubular member 10.

Figure 4:
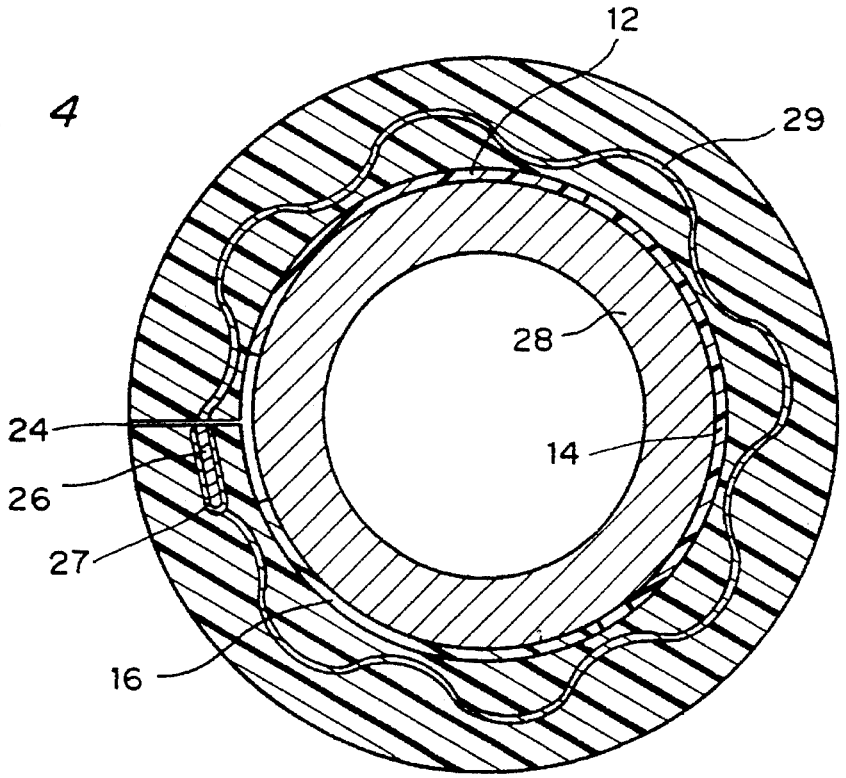
FIG. 4 is a cross section taken at 4—4 on FIG. 3 of the pipe protector installed onto the pipe.

FIG. 4 is a cross section of a three flap embodiment installed on a pipe which has the outer diameter to accommodate all three flaps to provide for a secure fit for the pipe protector. The cross section in FIG. 4 shows tubular member 10 installed around pipe 28 with opening 24 in the closed position secured by key 26. In the cross section metal member 29 is a corrugated insert. The metal member 29 has hollow interlocking teeth one of which is shown in the cross section at reference numeral 27. Key 26 goes through a series of metal teeth that are covered by rubber, thereby securing the closure of the pipe protector around the pipe. The rubber flaps 12, 14 and 16 are shown between the pipe 28 and tubular member 10 providing additional inner thickness for the pipe protector to compensate for the undersized pipe. In the preferred embodiment there is a space provided between the flaps on either side of the opening 24 and key 26 so the flaps will not interfere with the closure.

Figure 5:
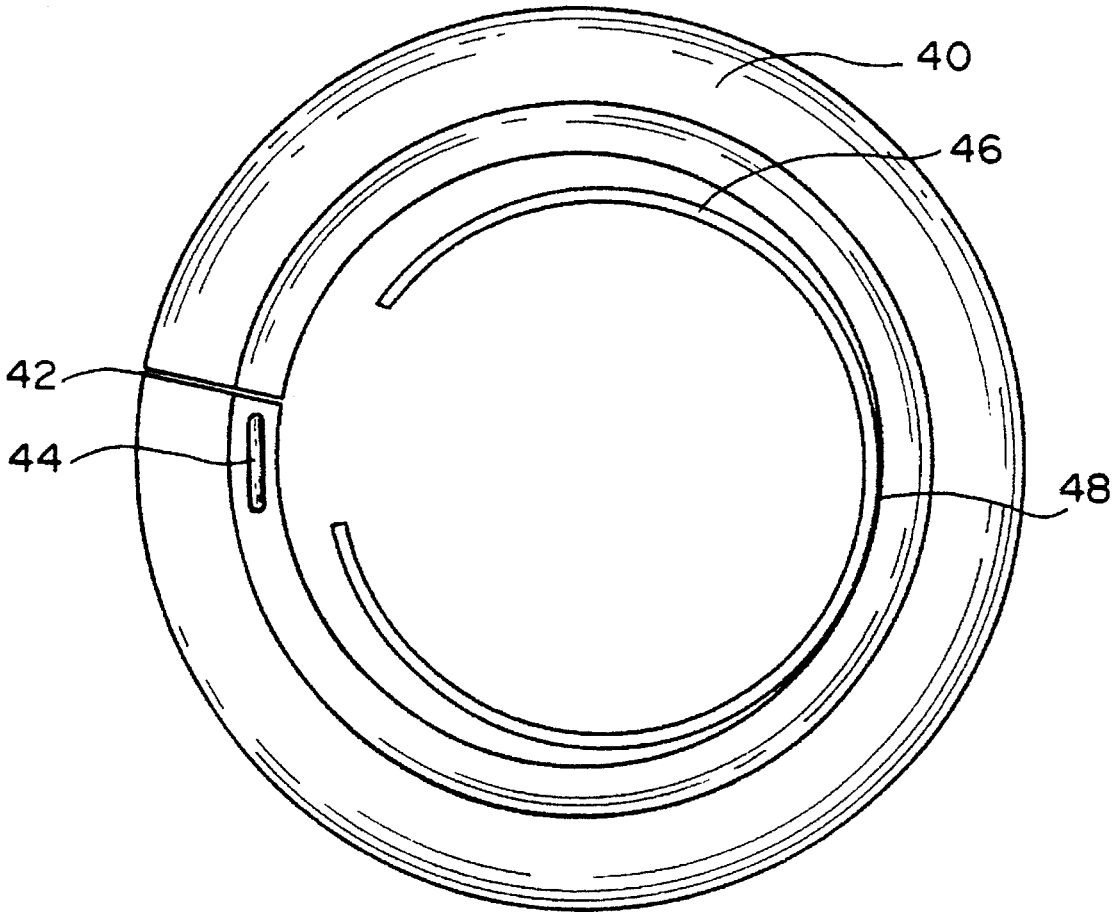
FIG. 5 is a top view of a preferred embodiment with one flap.

FIGS. 5 is a single flap embodiment illustrated by a top view to show the flap. The rubber tubular member 40 is the pipe protector body and in the preferred embodiment for this design is a split type protector as described herein. The opening 42 to facilitate the introduction of the pipe as well as the key 44 are the same as described above for other embodiments with multiple flaps. The embodiment shown in FIG. 5 has one flap 46 with a point of attachment 48. The flaps can be attached at more than one point as long as it is easily removed. With the single flap design, a portion of the flap is severed and removed, leaving sufficient flap material to compensate for the undersized pipe and provide a tight grip.

In a field installation the pipe protector of the present invention would be test fit on the pipe. If the pipe protector fits securely and comfortably around the outer diameter of the pipe with all flaps in place, no flaps are removed. If the flaps provide too much volume for a good fit, flaps may be removed as needed until the proper fit is obtained. The flaps are attached so that detachment can be done manually. In the preferred embodiment the flaps are attached by an adhesive such as rubber cement. In an alternative embodiment, a mechanical fastener such as a staple may be used. In the single flap embodiment, a portion of the flap is severed, detached and the pipe protector is refitted on the pipe. Additional flap material can be severed and detached until the proper fit is obtained.

The following Table 3 illustrates the benefits of the variable diameter pipe protector. Drill pipe with outer diameters ranging from 5.00 inches to 4.830 inches were tested to determine the side load force on the pipe that would cause the pipe protector to slip. Standard drill pipe for a 5 inch outer diameter is often undersized. The API minimum for 5 inch pipe is 4.830 inches. A three flap variable diameter pipe protector as described herein was used in the side load test. The testing machine allows the measurement of slippage between the casing and the rotating pipe protector. Drilling fluid also may be injected between the casing wall and the rotating pipe protector to simulate actual drilling conditions. The testing procedure was developed by Mauer Engineering Inc., 2916 West T. C. Jester, Houston, Tex. 77018. The procedure is published in a paper entitled "Laboratory Drill Pipe Protector Tests", Garkasi Ali; Hall, Russell W. Jr., and Deskins, W. Gregory; PD Vol. 56 Drilling Technology, Editor: John P. Vozniak, Book No. G00827, ASME (1994); presented at Energy Sources Technology Conference & Exhibition, New Orleans, La. Jan. 23–26, 1994. The standard pipe protector without flaps is designed to fit securely around a pipe with a 5 inch outer diameter.

TABLE 3

Variable Diameter Pipe Protector Test Results

| Pipe Outer Diameter | Slip Loads (lbs) Standard | 1 Flap | 2 Flap | 3 Flap |
|---|---|---|---|---|
| 5.00 | 9663 | NT | NT | NT |
| 4.975 | 7920 | 11102 | >12000 | >12000 |
| 4.950 | 3870 | 7945 | 10644 | >12000 |
| 4.900 | 706 | 4890 | 6990 | >12000 |
| 4.830 | <100 | <100 | 5113 | 8072 |

NT = Not Tested

As shown in Table 1 the standard pipe protector sized to fit a 5 inch pipe slips on a 5 inch pipe at 9663 lbs. side load. The test machine capacity was 12,000 lbs. As the pipe diameter decreased, the additional volume provided by the flaps compensated for the difference in diameter and prevented slippage. In most cases, variable size pipe protector prevented slippage on a pipe with undersized diameters at a side load exceeding the side load that caused slippage of the standard pipe protector on a 5 inch pipe.

The examples provided in this specification are not intended to limit the scope of the claimed invention. Those skilled in the art will appreciate additional embodiments and variations that can be practiced based in addition to those disclosed herein.

What we claim is:

1. In a latch-on pipe protector having an annular body of rubber that is split longitudinally and a split metal sleeve embedded in the body of rubber having sufficient resiliency to allow the edge of the split to be spread apart far enough to pass over a joint of drill pipe, said edges of the split in the metal sleeve having teeth that are covered by the rubber of the annular body of rubber and mesh when the protector is installed on a drill pipe, and a key for extending through the meshing teeth to latch the protector on the pipe and cause the rubber between the metal sleeve and the pipe to be compressed sufficiently to resist the movement of the protector relative to the pipe, the improvement comprising at least one detachable rubber flap attached to the inside surface of the protector to compensate for undersize pipe diameters.

2. A pipe protector comprising a tubular rubber member with an inner diameter sized to the approximate outer diameter of the pipe;

an opening the length of the tubular rubber member capable of separation at the opening to facilitate the introduction of a length of pipe;

a closing means to secure the tubular rubber member around the pipe; and multiple detachable rubber flaps attached to the inside surface of the tubular rubber member with an adhesive and extending the length of the tubular rubber member.

3. A pipe protector of claim 2 wherein the tubular rubber member and the rubber flaps are made of rubber with the same polymer and additive constituency to provide for the same chemical resistance.

4. A pipe protector of claim 2 wherein the flaps do not overlap each other.

5. A pipe protector of claim 2 additionally comprising generally cylindrical metal insert covered by the rubber tubular member.

6. A pipe protector comprising a generally cylindrical metal member with an opening of interlocking teeth the length of the cylindrical metal member;

a rubber tubular member surrounding and covering the metal member whereby the metal member is an insert in the rubber tubular member;

said rubber tubular member with an inner diameter sized to the approximate outer diameter of the pipe and having an opening the length of the tubular member capable of separation at the opening to facilitate the introduction of a length of pipe;

said opening of the tubular member formed of interlocking rubber teeth covering the teeth of the metal member;

a closing means to secure the tubular member around the pipe; and multiple detachable rubber flaps attached to the inside surface of the tubular rubber member by an adhesive and extending the length of the tubular rubber member.

7. A pipe protector of claim 6 wherein the cylindrical metal member is smooth.

8. A pipe protector of claim 6 wherein the cylindrical metal member is corrugated.

9. A pipe protector of claim 6 wherein said closing means is a latch key inserted through an opening formed in the interlocking teeth of the metal member and rubber tubular member.

* * * * *

UNITED STATES PATENT AND TRADEMARK OFFICE

CERTIFICATE OF CORRECTION

PATENT NO. : 5,465,759
DATED : November 14, 1995
INVENTOR(S) : Douglas W. Carlson and
Stephen P. Simons It is certified that error appears in the above-indentified patent and that said Letters Patent is hereby corrected as shown below:

On the title page, Item

--[75] Inventors: Douglas W. Carlson; Stephen P. Simons, both of Kingwood, Tex. --

The second inventor's name was misspelled. His family name is --Simons-- and not "Simmons".

Signed and Sealed this

Third Day of December, 1996

Bruce Lehman

*Attest:*

BRUCE LEHMAN

*Attesting Officer*

*Commissioner of Patents and Trademarks*